United States Patent [19]

Harmon

[11] Patent Number: 4,676,416

[45] Date of Patent: Jun. 30, 1987

[54] WALKER AND CARRIER THEREFOR

[76] Inventor: Carol A. Harmon, 313 Aspectuck Trail, Huntington, Conn. 06484

[21] Appl. No.: 871,258

[22] Filed: Jun. 6, 1986

[51] Int. Cl.[4] ..... A61H 3/00

[52] U.S. Cl. ..... 224/42.46 R; 135/67; 224/901; 297/DIG. 4; 383/121

[58] Field of Search ..... 297/5, 6, DIG. 4; 135/67; 224/32 R, 32 A, 35, 36, 253, 42.46 R, 901; 150/55, 127, 129, 130, 50; 383/121

[56] References Cited

U.S. PATENT DOCUMENTS

| | | | |
|---|---|---|---|
| Re. 24,817 | 4/1960 | Hogan | 297/DIG. 4 |
| 1,134,577 | 4/1915 | Apple | 224/36 |
| 1,339,851 | 5/1920 | Josephson | 150/50 |
| 1,577,298 | 3/1926 | Roeller | 224/42.46 R |
| 2,119,789 | 6/1938 | Krout | 150/50 |
| 2,424,195 | 7/1947 | Schwinn | 224/36 |
| 2,759,525 | 8/1956 | Ries | 135/67 |
| 2,846,699 | 8/1958 | Watson | 224/42.46 R |
| 3,173,464 | 3/1965 | Curtis | 150/50 X |
| 3,517,677 | 6/1970 | Smith | 297/5 X |
| 3,813,017 | 5/1974 | Pimsleur | 224/253 X |
| 3,957,071 | 5/1976 | Kenner | 135/67 |
| 4,074,683 | 2/1978 | DiChiara | 135/67 |
| 4,179,159 | 12/1979 | Sieklucki et al. | 297/DIG. 4 |
| 4,184,618 | 1/1980 | Jones | 297/5 X |
| 4,339,061 | 7/1982 | Dunn | 224/901 |
| 4,449,750 | 5/1984 | Pultman | 297/DIG. 4 |
| 4,452,484 | 6/1984 | Pastor | 297/5 |
| 4,491,257 | 1/1985 | Ingles | 297/188 |

FOREIGN PATENT DOCUMENTS

| | | | |
|---|---|---|---|
| 2161085 | 1/1986 | United Kingdom | 135/67 |

*Primary Examiner*—Stephen Marcus

*Attorney, Agent, or Firm*—Arthur T. Fattibene

[57] ABSTRACT

An invalid walker and carrier therefor, wherein the carrier is constructed so as to be readily collapsible and portable, and to provide for greater utility and purpose; and which is constructed so that it can be detachably connected to any of the more popular walkers. The carrier includes a bottom panel having a connected circumscribing side wall, both of which are formed from flexible sheet fabric type materials, wherein the bottom panel is formed with a co-extensive pocket for detachably receiving a rigid member for stabilizing the carrier. The carrier is also provided with straps to form hanging loops for suspending the carrier from the upper frame portion of the walker. The hanging loops or straps are arranged so that the carrier can be readily attached to any of the popular walker constructions so that the carrier is disposed within the area defined by the leg members of the walker.

1 Claim, 6 Drawing Figures

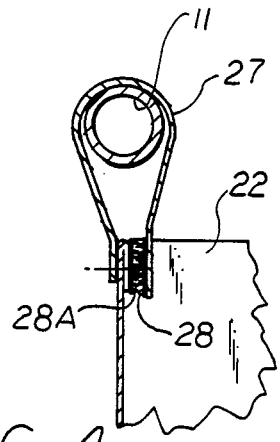
FIG. 4
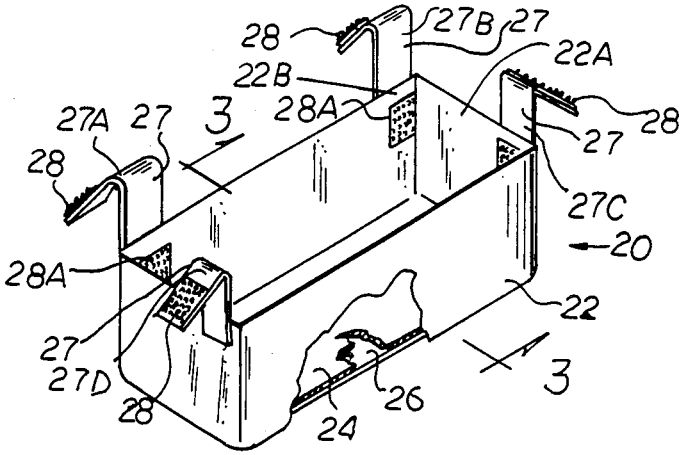
FIG. 2
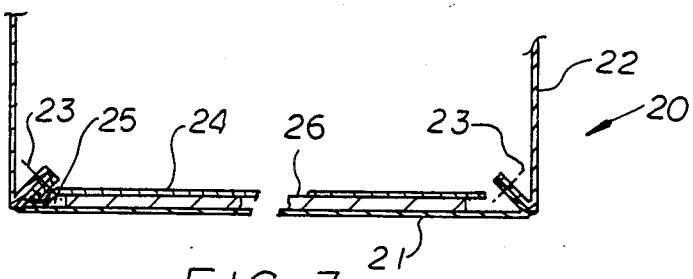
FIG. 3
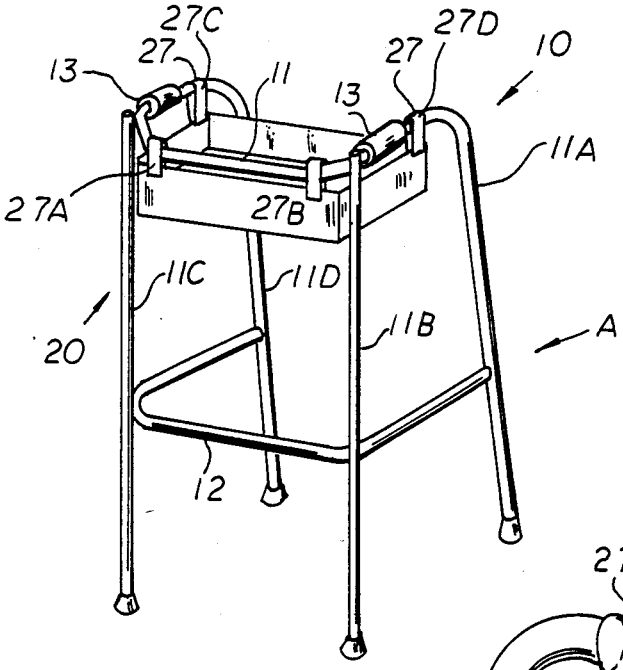
FIG. 1
FIG. 5
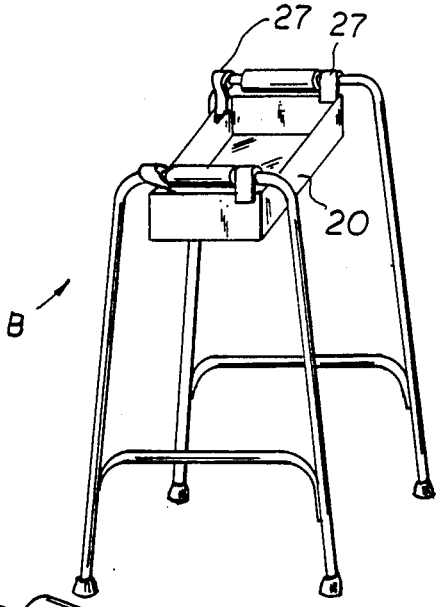
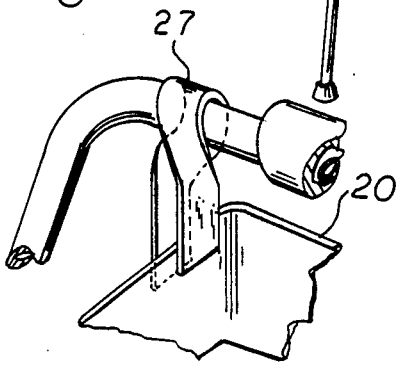
FIG. 5A

WALKER AND CARRIER THEREFOR

FIELD OF INVENTION

This disclosure is directed to invalid walkers, and more specifically to an improved universal type of carrier which is both collapsible and portable for use with any of the standard types of walkers.

PROBLEM AND PRIOR ART

It is known that invalid walkers have become a common aid for persons who are aged, handicapped, injured and/or recovering from various illnesses and/or accidents which impair one's ability to walk. Also, such walkers are commonly used both in hospitals and in the home by persons afflicted with a disability or walking handicap. The more popularly known walkers are those defined by an upper U-shaped member which is connected to rectangularly disposed leg members, e.g. the type disclosed in U.S. Pat. Nos. 3,957,071 and 2,798,533; or of the type disclosed in U.S. Pat. No. 4,074,683, which include a pair of inverted U-shaped members to define the rectangularly disposed leg members interconnected by intermediate cross braces or members. U.S. Pat. No. 1,394,224 illustrates the inverted U-shaped type walker provided with wheels so as to enable the walker to be rolled. In operation, the noted invalid walkers are similar. The individual requiring the aid of such walker positions himself or herself behind the open side of the walker while grasping the upper member or portion of the walker which may be provided with hand grips. The person then moves and plants the walker a short distance forward, and then proceeds to make a step or two in advancing toward the walker, while being stabilized or balanced by the walker. Such use therefore requires the person to firmly hold onto the walker with both hands. When used in hospitals, the patient or user of such walkers are generally dressed in a conventional hospital gown. When used in the home, the user or patient may likewise be dressed in a gown or robe. Even if fully clothed, it will be noted that manipulation of such a walker makes it extremely inconvenient, if not impossible, for the user to carry many of the personal articles one normally needs throughout the course of a day.

The carrier heretofore known for use with such walkers frequently lacked the necessary convenience for which they were intended, and/or were so located so as to render the operation of the walker difficult. It is to be appreciated that the users of such walkers are generally quite feeble, weak and/or extremely handicapped. Therefore, any attachment to such walkers that will tend to unbalance the walker and/or disturb the center of gravity of its designed construction could conceivably render the walker incapable of being used by any such extremely weak, fragile or handicapped person.

OBJECTS

An object of this invention is to provide for a readily light weight, portable carrier which can be universally applied to the known standard types of invalid walkers.

Another object is to provide an improved carrier for use with walkers that is relatively simple in construction and positive in operation.

Another object is to provide a carrier for use with walkers and which is operatively associated therewith in a manner such that it will not interfere with the user, and will not upset the equalibrium of the walker.

Another object is to provide an improved carrier construction for use with walkers whereby the personal articles adapted to be carried thereby are rendered readily accessible to the user.

Another object is to provide a carrier that is inexpensive to fabricate and which can be readily formed of inexpensive and readily expendible materials.

SUMMARY OF THE INVENTION

The foregoing objects and other features and advantages are attained by a carrier which is specifically constructed so that it can be universally applied to any of the known standardized walkers and which is supported thereon in a manner that will not upset the balance or equalibrium of the walker. The carrier is formed of a readily foldable material, e.g. fabric or expendible plastic that includes a bottom panel of generally rectangularly shape, sized to fit within the area defined by the conventional four rectangularly disposed leg members. Connected to the bottom panel is a circumscribing strip of fabric to define the rectangularly disposed side walls of the carrier. A pocket forming panel co-extensive in shape to the bottom panel is connected thereto to define an open ended pocket for receiving a rigid board to form a rigid bottom for the carrier. A plurality of hanger straps are circumferentially spaced about the upper edges of the end wall of the carrier. The plurality of straps are located so as to suspend the carrier from the upper members of the known standard walker so that the periphery of the carrier is disposed within the area defined by the walker legs. The straps are formed so that they can be readily looped over the upper walker member and detachably fastened to define a hanging loop.

FEATURES

A feature of this invention resides in the provision of a simply constructed carrier which can be detachably connected to the walker in a manner whereby the balance and/or stability of the walker is not adversely affected.

Another feature is to provide a walker with a carrier whereby the personal articles carried thereby are readily accessible to the user.

Another feature is to provide a walker with a readily expendible carrier which renders the use thereof particularly suitable for hospital use.

Another feature resides in the provision whereby the hanging straps are particularly located so that the carrier can be readily suspended from the upper members of variously designed walkers.

Another feature resides in the provision of a carrier for use with walkers that is constructed so as to be suspended from the upper walker members and within the area defined by the walker leg members.

Other features and advantages will become more readily apparent when considered in view of the drawings and detailed description in which:

FIG. 1 is a perspective view of a walker and carrier embodying the invention.

FIG. 2 is a detail perspective view of the carrier of the present invention.

FIG. 3 is a sectional view taken along line 3—3 on FIG. 2.

FIG. 4 is a detail view of the loop construction embodied on the carrier.

FIG. 5 is a perspective view of the carrier as applied to a modified walker construction.

FIG. 5A is an enlarged construction detail of the embodiment disclosed in FIG. 5.

DETAIL DESCRIPTION

Referring to the drawing, there is shown therein a walker 10 of a well known construction. The illustrated walker 10 includes a generally U-shaped upper frame member 11 which is horizontally disposed and having opposed side frame portions interconnected by a cross-piece wherein the open end of the U-shaped member is to the rear of the walker 10. Connected to the U-shaped member as shown are rectangularly disposed leg members 11A, 11B, 11C and 11D. The respective leg members may be suitably braced intermediate the ends thereof as shown at 12. A person using such walker generally stands to the rear of the walker 10, while grasping with each hand a grip 13 provided on the opposed ends of the U-shaped member.

In order that such a person requiring the need of such walker may conveniently carry various personal articles as may be required from time to time, a carrier 20 is provided. The construction of the carrier is such that it can be readily suspended from the upper frame member 11, whereby the carrier 20 is disposed within the area defined by the leg members 11A, 11B, 11C and 11D. In this manner, the weight of the carrier and/or its contents are centrally supported in a manner which will not adversely effect the operation of the walker; and/or upset the equalibrium or the center of gravity thereof.

This is attained by a carrier 20 that comprises a bottom wall panel 21 which is sized so as to be received within the area defined by the leg members 11A, 11B, 11C and 11D. In the illustrated embodiment, the bottom panel 21 may be cut or formed of a suitable fabric material. Connected to the peripheral portion of the bottom panel 21 is a circumscribing end wall panel 22. Preferably, the end wall panel 22 comprises a single strip of fabric having a length generally co-extensive to the perimeter of the bottom panel. The strip of material 22 is secured at its lower edge to the perimeter of the bottom panel 21 by a sewn seam 23; or other suitable connecting means e.g. pressure sensitive adhesives, tape, and the like. The strip 22 is attached to the bottom panel so that the opposed ends 22A, 22B of the strip meet at a corner portion, and the ends 22A, 22B being secured e.g. by sewing. Thus, a generally rectangularly shaped carrier is formed having front, rear and interconnected end wall portions.

In accordance with this invention, a pocket forming panel 24 congruent in shape to the bottom panel 21 is superimposed thereon, and the pocket panel 24 secured to the bottom panel about three sides thereof to define therewith an open ended pocket 25. A rigid board 26 formed of a light weight material, e.g. cardboard, fiber board or rigid plastic sheet, may be inserted into the pocket 25 to add rigidity to the bottom portion of the carrier and to stabilize the rectangular shape of the carrier in the operative position.

The carrier described is arranged to be detachably connected to the walker. In the illustrated embodiment, this is attained by attaching a plurality of straps 27 to the upper edge of the circumscribing strip 22. The respective straps 27 are suitably secured at one end to the end wall e.g. by sewing. The free end of the respective straps 27 are adapted to be looped over the upper walker member 11, whereby the free end of the straps is detachably secured to itself or the adjacent edge portion of the end wall. In the illustrated embodiment, the detaching means comprises a "Velcro" type material. As shown, a strip of such "Velcro" type material 28 is attached to the free end of the strap and a complementary strip 28A of such "Velcro" type material is attached to the other end of the strap or adjacent inner surface of the end wall to which the free end is secured in its looped forming position.

To render the carrier 20 thus described universally adaptive to the known walkers of different construction, it is preferred that the respective straps 27 be secured adjacent the respective corner portions of the rectangularly shaped carrier. For example, straps 27A, 27B may be connected to the front vertical wall portion of the carrier closely adjacent the corner portions thereof. The other two straps, 27C, 27D, may be connected to its corresponding end wall portion adjacent the other corners of the end wall portions that define the back wall portion. Thus, the carrier 20 described can be readily suspended from the upper member of walker A or from the opposed upper frame members of walker B as respectively illustrated. In either event, the carrier 20 is suspended within the confines of the respective walker leg members, making the articles carried therein readily accessible to the user. The physical location of the carrier is disposed so that there is no interference with the user, and that the weight thereof is uniformly distributed over the center of gravity of the walker.

By forming the carrier 20 of an all-fabric construction, it can be readily cleaned as by washing. It will be also understood that for hospital applications, where cross-contamination may present some problems, the carrier 20 can be fabricated entirely of readily expendible sheet plastic material. Also, instead of using sewn seams, the seams could be formed by heat sealing. Thus, at the end of a given day, a carrier formed of readily expendible material could be readily disposed for sanitary reasons.

While the invention has been described with respect to several embodiments, it will be understood and appreciated that variations and modifications may be made without departing from the spirit or scope of the invention.

What is claimed is:

1. In combination with an invalid walker of various known standard construction that includes a horizontally disposed upper frame member having opposed side frame portions which may or may not include an interconnecting cross piece, and a plurality of rectangularly disposed leg members connected to said upper frame member, a readily collapsable and light weight portable carrier for holding various articles adapted to be readily attached to said various standard walkers, said carrier comprising a flexible rectangularly shaped bottom panel formed of a readily washable material sized to fit within the area defined by the rectangularly disposed leg members of said standard walkers, a flexible circumscribing end wall panel formed of a washable material connected to the peripheral portions of said flexible bottom panel to define rectangularly disposed end wall portions, a pocket panel formed of washable material connected in overlying relationship to said bottom panel to define an open ended pocket, a rigid board member removably mounted in said pocket to provide rigidity to said bottom panel, and a plurality of hanging straps formed of a readily washable material circumferentially spaced about said end wall panel, each of said straps having one end fixedly connected to said circumscribing end wall panel adjacent to the corner portions thereof, and each of said straps having a free end which is adapted to be reversely folded over the upper frame member of a walker, and fastening means for detachably securing the free end of the respective strap whereby said carrier is suspendedly supported from said upper frame member so as to be disposed within the area of the rectangularly disposed leg members so that the weight of the carrier and articles carried thereby is distributed over the center of gravity of the walker, said fastening means including complementary interlocking fabric type fasteners, said rectangularly disposed end wall portions defining a front and rear end wall portion interconnected by a pair of opposed end, end wall portions, and whereby said plurality of straps include a pair of straps spacially connected to said front end wall portion adjacent the opposed ends thereof, and a strap connected to each of said end, end wall portions adjacent the end thereof remote from said front end wall portion whereby said straps are rectangularly disposed so that said pair of straps connected to said front end wall portion of said carrier can be optionally secured to either the opposed side frame portions or interconnecting cross piece of a walker depending upon the construction thereof, and each of said other strap being securable to the opposed side frame portion so that said carrier is rendered universally adaptable for connection to the upper frame member of a given walker construction.

* * * * *